United States Patent [19]

McClung

[11] Patent Number: 4,666,070

[45] Date of Patent: May 19, 1987

[54] SKI BOOT REMOVER

[76] Inventor: Andrew C. McClung, State Rte. 55 Red Oak, P.O. Box 447, Craigsville, W. Va. 26205

[21] Appl. No.: 871,474

[22] Filed: Jun. 6, 1986

[51] Int. Cl.[4] ..... A47G 25/80

[52] U.S. Cl. ..... 223/117

[58] Field of Search ..... 223/114, 115, 113, 116, 223/117

[56] References Cited

U.S. PATENT DOCUMENTS

| | | | |
|---|---|---|---|
| 33,543 | 10/1861 | Ridout | 223/117 |
| 63,292 | 3/1867 | Peffer | 223/117 |
| 374,076 | 11/1887 | Littleton | 223/117 X |
| 611,043 | 9/1898 | Spaid | 223/116 |
| 612,764 | 10/1898 | Anderson | 223/117 |

FOREIGN PATENT DOCUMENTS

| | | | |
|---|---|---|---|
| 664096 | 1/1952 | United Kingdom | 223/114 |

*Primary Examiner*—Robert R. Mackey

*Attorney, Agent, or Firm*—Birch, Stewart, Kolasch & Birch

[57] ABSTRACT

An arrangement for removing shoe wear from a wearer's foot, such as a ski boot or the like, wherein the boot may be clamped and retained on a support by a manually adjustable upright means operately associated with the boot support to hold and clamp various sizes of boot on the support to permit a person wearing the boot to withdraw his or her foot from the boot while standing in an erect comfortable position.

5 Claims, 4 Drawing Figures

SKI BOOT REMOVER

BACKGROUND OF THE INVENTION

The present invention relates to means to remove foot wear, such as ski boots in particular and such other types as are hard to remove from the wearer's foot.

For example, ski boots after a period of active use are extremely difficult to remove from the user's feet and many a pulled muscle may result from the bent-over position heretofore required to remove a ski boot by the wearer. Heretofore, the prior art for shoe-, boot-removers and the like are exemplified by the following patents: U.S. Pat. No. 206,523 to Bartine issued July 30, 1878; U.S. Pat. No. 785,045 to McDonald issued Mar. 14, 1905; U.S. Pat. No. 1,866,708 to Hook issued July 12, 1932 and U.S. Pat. No. 4,262,828 to Kosakai issued Apr. 21, 1981.

However, none of the prior art devices serve for easy action to remove shoes, boots or the like of different sizes. Accordingly, my invention is directed to an arrangement of co-actively engageable members to provide for easy removal of any size or form of tight-fitting shoe or boot by a person in an erect or standing position, whereby tired muscles are not strained or taxed by the shoe or boot removal operation. This often occurs after, for example, "a long day on the ski slopes."

SUMMARY OF THE INVENTION

Accordingly, it is a primary object of the present invention to provide a foot removing device which will accommodate boots of varying sizes and permit easy removal thereof while the wearer stands in an upright position.

It is another object of the present invention to provide a compact, portable and inexpensive boot removal device which may be easily transported to or stored at a ski lodge for boot removal on-site following a vigorous day on the ski slopes.

The objects of the present invention are fulfilled by providing a boot removing device for removing a boot from a wearer's foot comprising a boot support with a top surface for supporting a boot thereon, a heel conforming stop at the aft end of the surface, a plurality of transverse rabbet grooves spaced along a front end of the said top surface, and a moveable boot toe engaging means engageable selectively in any desired one of said grooves according to boot sizes to be removed from the wearer's foot, to thereby securely clamp the boot toe to the surface of the boot support in co-action with said heel conforming stop.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF PREFERRED EMBODIMENTS

Figure 1:
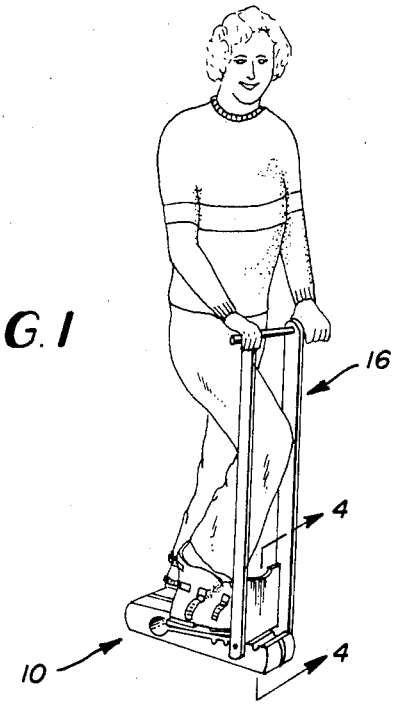
FIG. 1 is an assembled view in perspective of the invention showing the boot-receiving base, preferably slanted toward the aft or rear to the upstanding heel-engaging stop and the toe portion of the base with transversely-spaced slots, grooves or suitable rabbet cuts formed in the base to be engaged by the transverse dowel, suitably secured between the spaced side bars actuated by the operator's handle bar portion extended above the base.
Figure 2:
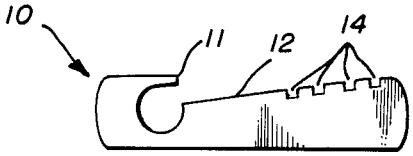
FIG. 2 is a side elevation of the base portion of the boot remover separate from the assembled view.

Referring in more detail to FIGS. 1 to 4, there is provided a base 10 having a heel conforming stop element 11 at the rear of slanted surface 12 on which a boot 13 with a heel 13B is resting. This surface 12 is provided with transversely spaced slots or rabbet grooves 14 arranged in spaced positions graduated for various shoe or boot sizes. The grooves rabbet to join with the transverse dowel 15. The dowel is carried by an upright frame 16 between side bars 16A, 16B. Dowel 15 is moveable into any one of the rabbet grooves necessary to clamp the boot toe 13A to the base surface under lower edge 18B of a transverse clamping plate 18.

Figure 4:
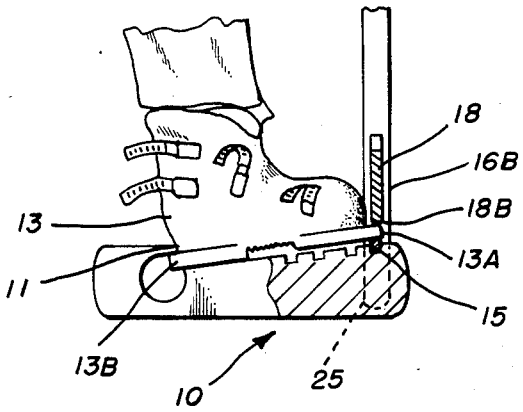
FIG. 4 is a partial sectional detail taken along a line 4—4 of FIG. 1 between the rabbet groove and the dowel, and clamping plate lower edge, as hereinafter described.
Figure 3:
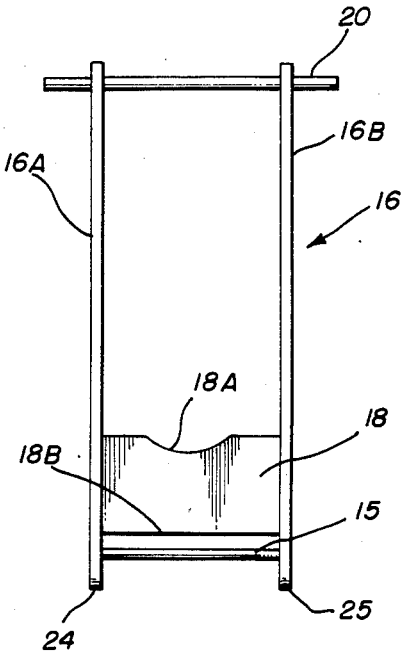
FIG. 3 is a front elevation of the moveable upright frame including a handle bar, spanned between the side bars and specific features of the moveable clamping plate and transverse dowel.

It is extremely advantageous to have the portable upright moveable frame 16 provided with a handle bar or like member 20 to impart conserted manual movement to spaced side bars 16A and 16B of the upright frame. These bars 16A, 16B below the handle bar 18 are spaced apart by clamping plate 18 and dowel 15. The clamping plate 18 may be concavely curved at the top 18A and formed with a straight clamping edge 18B at its lower part to extend between the bars 16A and 16B, but the straight edge 18B of the dowel plate 15 is countersunk with respect to the free ends 24 and 25 of the side bars 16A and 16B whereby the ends straddle the base. A toe clamping space is defined between the top of dowel 15 and clamping edge 18B (FIG. 4).

The free ends 24 and 25 shown in FIG. 1 of the assembled arrangement serve as guides when the dowel 15 is inserted into a selected spaced slot or rabbet groove on the base surface when the upright frame 16 is positioned.

In operation, when it is desired to remove a boot from a skier's foot, the skier unbuckles the boot and places his foot with the boot thereon on surface 12 of base 10 with the heel 13B engaged under stop edge 11 and the boot toe 13A tilted up. The upright frame 16 is then moved by the handle bar 20 to insert the toe 13A into the space between clamping edge 18B and dowel 15. Dowel 15 is then inserted into the closest rabbet or slot determined by the boot size and the skier presses firmly on the handle bar 20 to clamp the boot toe 13A in place. This results in rearward pressure to clamp heel 13 under stop edge 11. The skier may then easily remove the boot by lifting his leg and foot upwardly.

Without further description, it is believed that the advantages, purposes and operation of the co-acting parts of this invention are apparent, and it is to be expressly understood the same is not limited thereto, as various changes may be made in design and structure of the device as illustrated within the scope of the appended claims.

What I claim is:

1. A boot removing device for removing a boot from a wearer's foot comprising:

a boot support with a top surface for supporting a boot thereon;

a fixed heel conforming stop at the aft end of the surface;

a plurality of transverse rabbet grooves extending across the whole surface of and spaced along a front end of said top surface; and a boot toe engaging means selectively removable from the boot support and engageable in any desired one of said grooves according to boot sizes to be removed from the wearer's foot, whereby the boot toe is securely clamped to the surface of the boot support in coaction with said heel conforming stop without requiring the aid of another foot of the wearer.

2. A boot removing device as described in claim 1, wherein said boot toe engaging means comprises a co-active unit with a transverse dowel and clamping plate spaced thereabove, said dowel being adapted to engage with any selected one of said rabbet grooves, the space between the clamping plate and the dowel accommodating a toe portion of the boot to clamp the same to the surface of the boot support.

3. The boot removing device of claim 2 wherein said co-active unit comprises an upright frame having handle grips at a top end thereof to facilitate movement of the frame by the wearer, said dowel and clamping plate being disposed in a bottom end of said frame.

4. The boot removing device of claim 3 wherein said frame includes a pair of spaced side bars, the space between said side bars being slightly greater than the width of the boot support and top surface thereof, said clamping plate and dowel being countersunk from the bottom end of said side bars providing a space so that said side bars straddle said boot support when the boot toe portion is clamped therein against the support surface.

5. A ski boot-removing apparatus comprising a base having a boot support surface, said surface being transversely grooved at predetermined spaced intervals, a boot heel engaging stop on the aft end of the said surface, an upright frame with a transverse handle at the top thereof, said upright frame having spaced parallel bars extending from said handle, dowel means between said bars at a lower portion of said frame, said dowel means being so shaped and so formed as to permit manual insertion selectively in one of the grooves and clamping plate means spaced above said dowel means between said bars providing a space for accommodating a portion of a boot toe, the upright frame being movable by said handle to receive said boot toe portion in said space and clamp said boot on said surface between said clamping plate means and said boot heel engaging stop.

* * * * *